US005701820A

United States Patent [19]

Hanosek

[11] Patent Number: 5,701,820

[45] Date of Patent: Dec. 30, 1997

[54] DEVICE FOR WASHING AND DRYING PRINTING PLATES

[76] Inventor: Peter Hanosek, Staig 10, D-75236, Kämpfelbach-Ersingen, Germany

[21] Appl. No.: 569,146

[22] PCT Filed: Jun. 16, 1994

[86] PCT No.: PCT/EP94/01973

§ 371 Date: Jun. 21, 1996

§ 102(e) Date: Jun. 21, 1996

[87] PCT Pub. No.: WO95/00338

PCT Pub. Date: Jan. 5, 1995

[30] Foreign Application Priority Data

Jun. 18, 1993 [DE] Germany ..... 93 09 127 U
Jul. 16, 1993 [DE] Germany ..... 93 10 649 U

[51] Int. Cl.[6] ..... B41F 35/00

[52] U.S. Cl. ..... 101/424; 101/423

[58] Field of Search ..... 101/424, 423, 101/425, 475; 15/256.5, 256.51, 256.52

[56] References Cited

U.S. PATENT DOCUMENTS

| | | | |
|---|---|---|---|
| 176,171 | 4/1876 | Dow | 492/28 |
| 4,083,303 | 4/1978 | McInerny | 101/415.1 |
| 4,934,266 | 6/1990 | Fantoni | 101/375 |
| 5,033,376 | 7/1991 | Wiczak | 101/148 |
| 5,507,226 | 4/1996 | Burke et al. | 492/30 |

FOREIGN PATENT DOCUMENTS

| | | | |
|---|---|---|---|
| 1237691 | 6/1960 | France | 492/36 |
| 176096 | 10/1984 | Japan | 101/424 |
| 76395 | 4/1985 | Japan | 101/425 |
| 401110148 | 4/1989 | Japan | 101/425 |
| 614866 | 7/1978 | U.S.S.R. | 492/31 |

*Primary Examiner*—Edgar S. Burr
*Assistant Examiner*—Anthony H. Nguyen

[57] ABSTRACT

A device for washing and drying printing plates has a run-in table (1) followed by a series of washing, rinsing, conserving and/or gumming and drying stations (2, 3, 4, 5), and pairs of rolls (10, 11) arranged in the various stations with a horizontal axis of rotation and a roll slit that lies at the level of the run-in table (1). At least one roll of each pair of rolls (10, 11) may be driven so as to feed the printing plates engaged by the rolls (10, 11) through the roll slit. The device finally has a run-out table (6). In all stations (2, 3, 4, 5) are provided longitudinal guiding means (12) aligned in a common line together with the conveyor (26) of the pairs of rolls (10, 11) All longitudinal guiding means (12) lie either above or below the roll slit and delimit after the roll slit an obstacle-free passage through all stations (2, 3, 4, 5).

17 Claims, 3 Drawing Sheets

DEVICE FOR WASHING AND DRYING PRINTING PLATES

Figure 1:
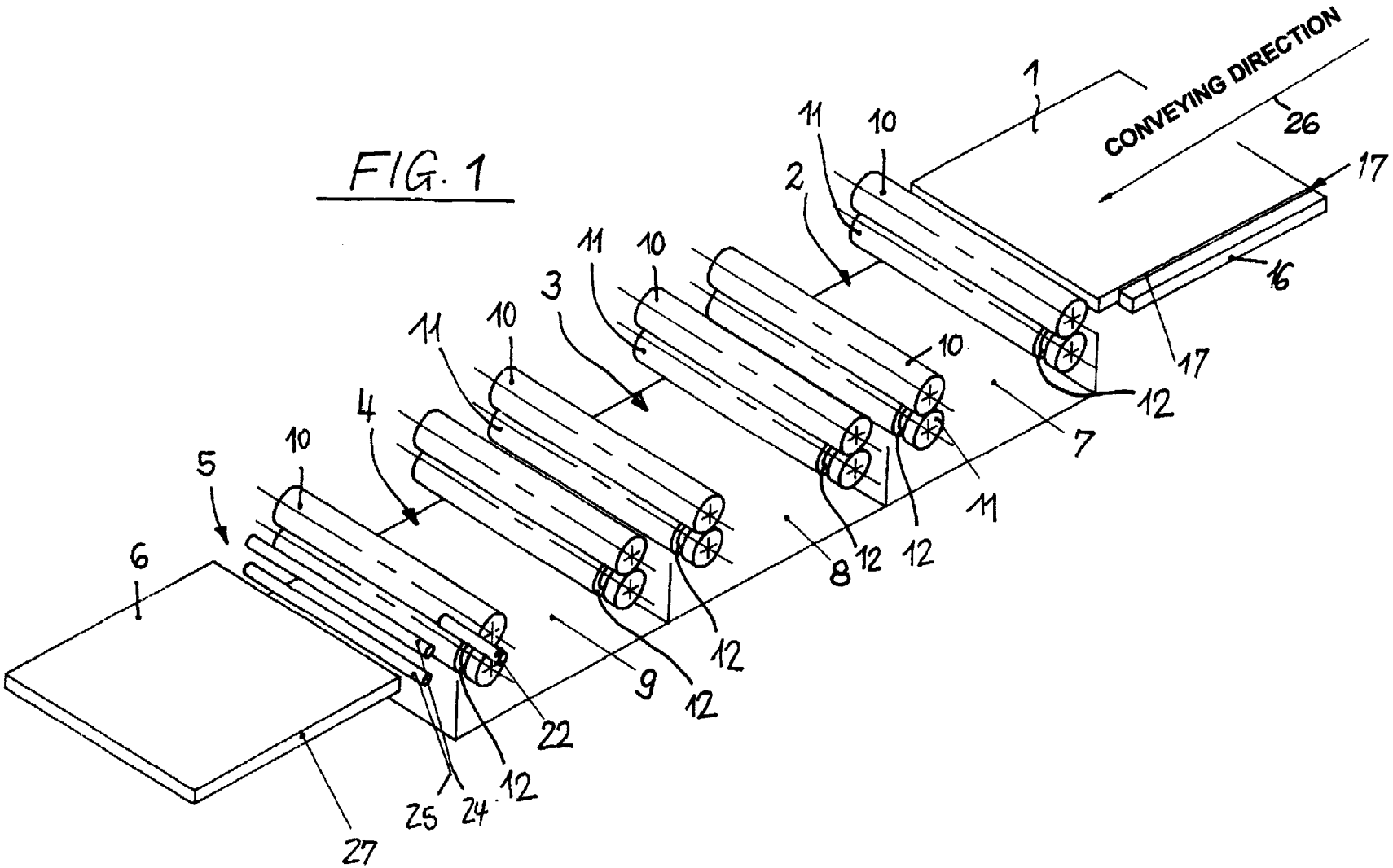

The invention starts with a device for washing and drying plates with characteristics described in the preamble of claim 1 This kind of device is used in a process involving several work stations for removing paint, keeping capillaries open and preserving or rubberizing and drying the surface of offset printing plates which are removed from the printing press after printing. The aim is to obtain a perfectly clean and preserved offset printing plate which can be archived and, in case of repeat orders, be reused in the printing press since it will remain in excellent condition.

The known device is provided with, sequentially, a washing station for removing the paint from the surface of the printing plate, a rinsing station for rinsing off the washing liquid and a station for preserving or rubberizing the printing surface of the printing plates, as well as a drying device consisting of rolls for squeezing out the liquid from the printing plate and/or of blow nozzles directed against the printing plate.

The printing plates are guided horizontally through the work station by pairs of rolls. The openings between the rolls, or roll gaps, are located on equal elevation and the printing plates are guided and conveyed by the clamping action of the pairs of rolls, whereby at least one roll per pair of rolls is a driving member.

The known device functions quite well with plane printing plates. When clamping the printing plates in a printing press, the edge of the printing plate is likely to bend, and the more the edge is bent, the more difficult it is to convey the printing plate between the pairs of rolls. There is greater wear on the rolls and liquid is spread from one station to the next, since the pairs of rolls are unable to sufficiently squeeze out the liquid from the printing plate as a consequence of the bent edge.

The object of the present invention is to create a washing and drying device which is also well suited for printing plates with a bent edge.

This object is solved by a device with characteristics given in claim 1. Advantageous further embodiments of the invention are the subject of the dependent claims.

The invention ensures an unobstructed passageway for the bent edge of a printing plate through all work stations of the device, either above or below the roll gap. Longitudinal guides marking the boundary of the passageway, are aligned with each other in a common line of sight in all work stations of the device. When a printing plate with bent edge is fed into the device in such a way that the bent edge is aligned parallel to the conveying direction, and that it is positioned in the passageway adjacent to the roll gap and can pass freely through the device, then the pairs of rolls grip only the plane area of the printing plates and are not hindered by the bent edge in doing this. The longitudinal guides for the bent edge marking the lateral boundaries of the unobstructed passageway through the device ensure that the plane area of the printing plates cannot drift from the roll gaps in transverse direction with respect to the conveying direction.

The guides are preferably located below the roll gap, so that the printing plate can be conveyed through the device with its printing side pointing upward and washed from the top. Since the bent edge points downward, there is no dead space on the top side where washing or rinsing liquid could accumulate, but the liquid can run off over the bent edge which also forms a dripping edge.

The guides are preferably formed by providing a circumferential groove in the cylindrical surface of the lower or upper roll of each pair of rolls into which the bent edge of the printing plate can project. Then, the boundaries of the groove represent at the same time the longitudinal guides. Should the bent edge come in contact with the boundary of the longitudinal guide, then it is virtually impossible that the plate is delayed at this boundary by friction in the longitudinal guide, but, a near friction free straight course is ensured, since the longitudinal guide is turning together with the rolls.

It would also be possible to feed the printing plates with bent edge into the device in such a way that the bent edge projects in the direction of the bearing pin of the lower roll beyond the end of its cylindrical surface. The upper cylindrical surface of the roll is longer and juts over the bent edge in order to ensure that the liquid is squeezed out over the entire plate surface. In this case the end of the cylindrical surface of the roll serves as a guide on the one side of the bent edge of the printing plate, and on the other side of the bent edge a separate guide, fixed to the support frame, is provided, in particular, a guide rail running parallel to the conveying direction.

The guides preferably extend to the input table of the device, so that the printing plates can be aligned with their bent edge in the desired line of sight and fed into the device. For this purpose the edge of the table could be utilized as part of the guide and, with a guide rail attached parallel to it, together forming an extension of the passageway through the device aligned in a common line of sight. But preferably the input table is made a little wider in order to provide a guide slot in it. A similar embodiment could also be provided at the output table, although this would not be necessary there. There, it would only be necessary to ensure that the bent edge of the printing plates can run out freely, for example, in case the bent edge points downward, by simply shortening the table sufficiently so that the bent edge of the plate runs next to the output table.

Since the rolls in the device according to the invention can freely grip the plane area of the printing plates and squeeze out the liquid on it, significant leakage of liquid on the plane area of the printing plates from one station to the next cannot occur. However, in the area of the bent edge a problem can arise, to a certain extent, when attempting to dry the printing plates free of streaks after the preservation or rubberizing treatment. This usually occurs when applying preservative or rubberizing liquid to the printing side of the printing plate by means of the upper roll of the pair of rolls, more specifically, on the input side of the roll gap. Because the printing plate has a bent edge and a groove is provided in the roll to accommodate it, preservative or rubberizing liquid is likely to leak to the output side of the roll gap. This can be advantageously counteracted in a further embodiment of the invention by providing an air blow nozzle, arranged parallel to the roll by means of which the preservative or rubberizing liquid is applied, and directing it against the exit side of the roll gap, thereby counteracting leakage of preservative or rubberizing liquid which, in turn, promotes perfect, dust free drying of the printing plate.

A particular advantage of the invention lies in the fact that it cannot only process slightly bent edges, but also printing plates with an edge bent to a large angle, which may be even larger than 90 degrees, for example, 110 degrees.

An exemplary embodiment of the invention is shown in the attached schematic drawings.

Figure 2:
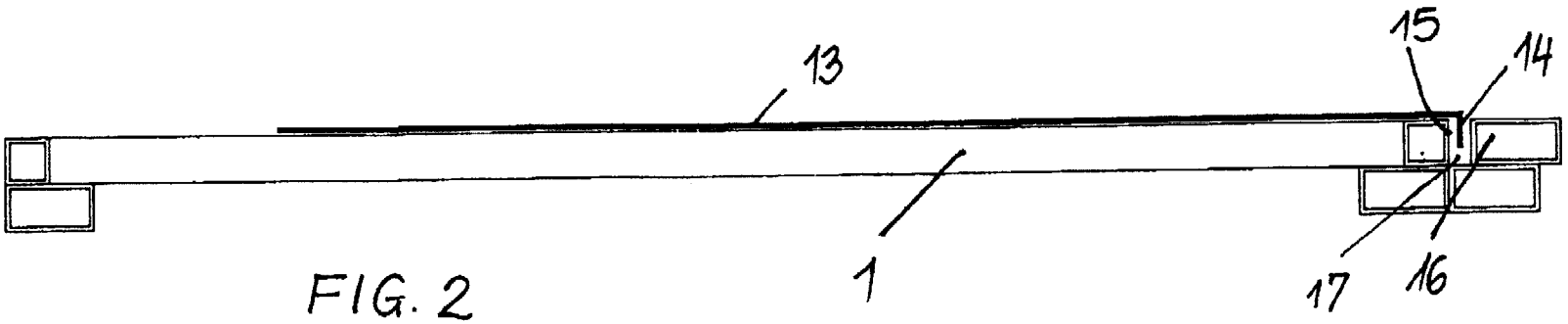
Figure 3:
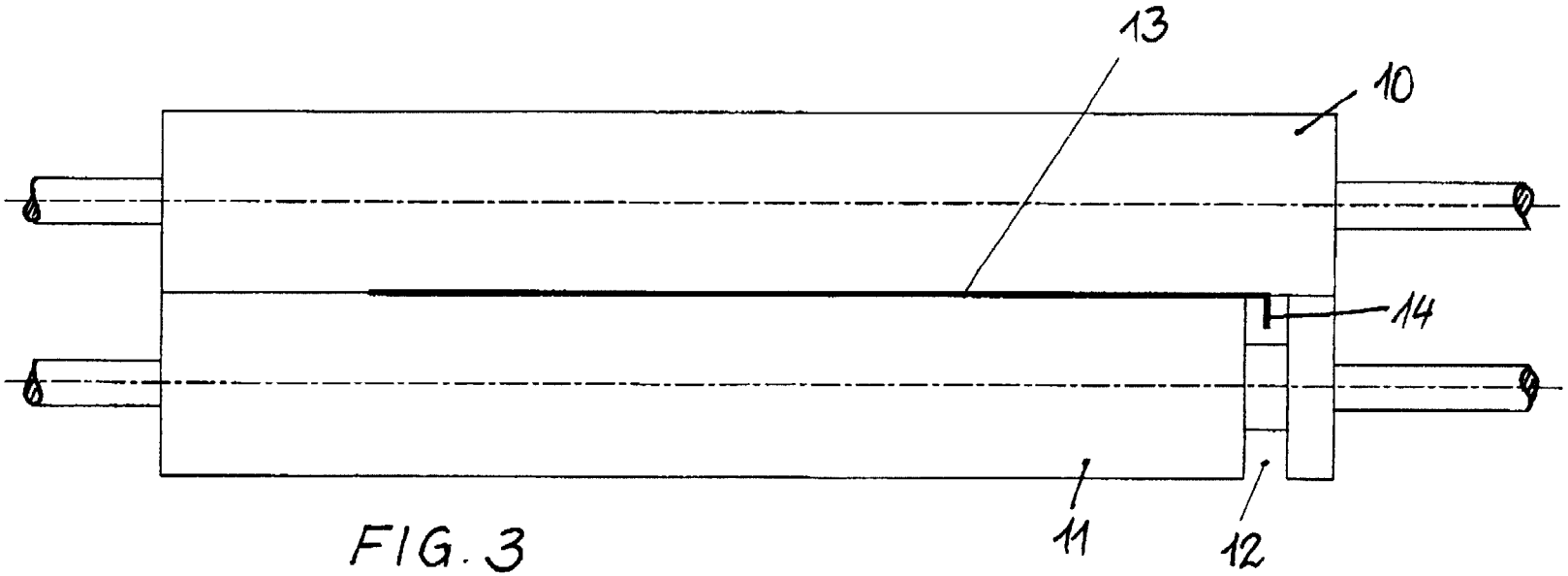
Figure 4:
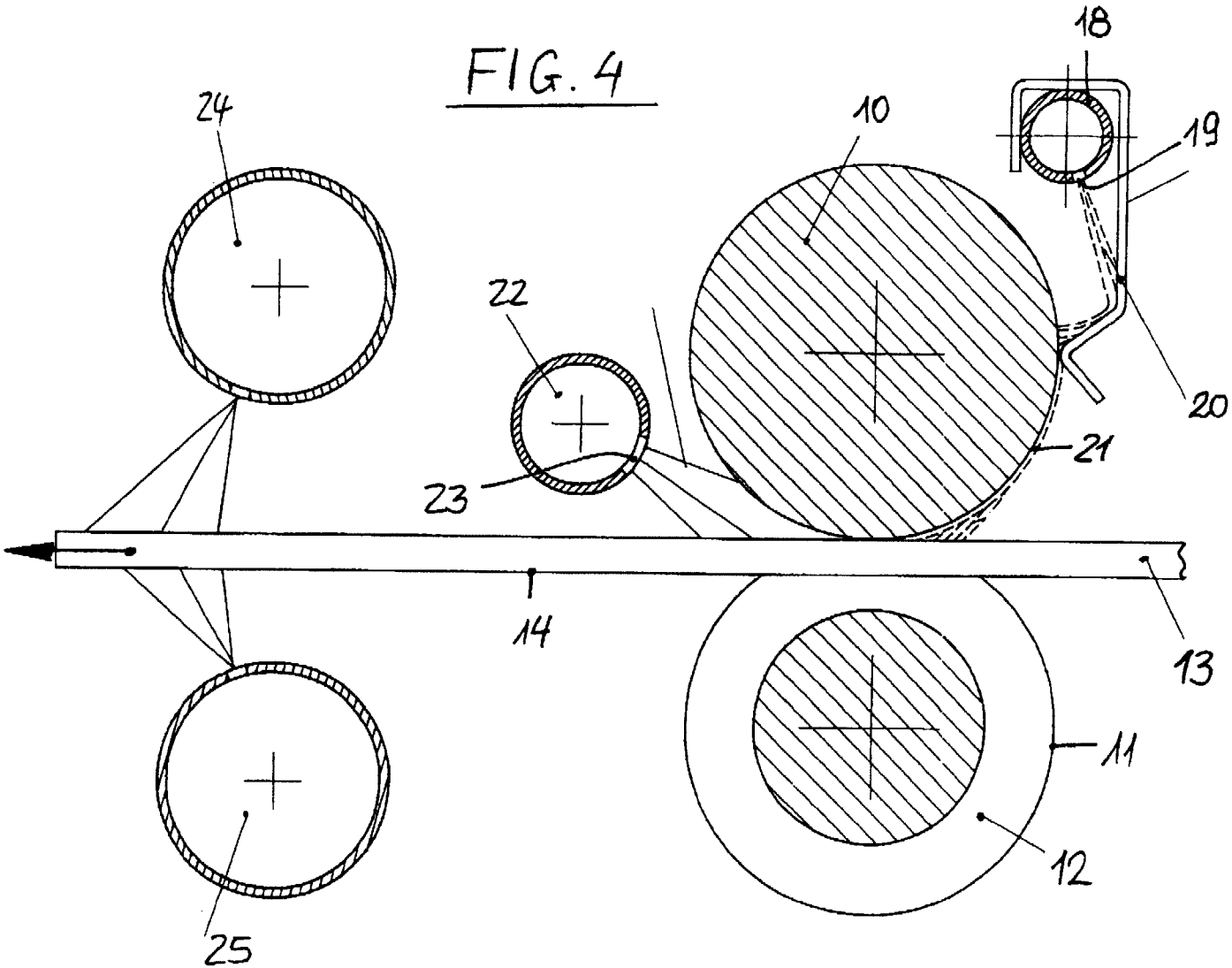

FIG. 1 shows the essential elements which are necessary for the understanding of an device for washing and drying of printing plates, in isometric view without support frame and enclosure, FIG. 2 shows as detail a cross-section through the input table of the device, FIG. 3 shows the elevation of a pair of rolls with a printing plate clamped in the roll gap, FIG. 4 shows as detail a longitudinal section through the last pair of rolls in the rubberizing station of the device followed by a drying station.

The device has, in succession, an input table 1, a washing station 2, a rinsing station 3, a rubberizing station 4, a drying station 5 and an output table 6. The washing station 2 includes a vat 7 for catching the washing liquid; the rinsing station 3 includes a vat 8 for catching the rinsing water; and the rubberizing station 4 includes a vat 9 for catching the rubberizing liquid. If required, additional washing and rinsing stations could be provided.

Each station is equipped with at least two pairs of rolls each consisting of an upper roll 10 and a lower roll 11, that is, a pair of rolls at the input side of the work station and a further pair of rolls at the output side of the work station. The duty of the pairs of rolls 10, 11 is to convey the printing plates, for which reason at least one roll in each pair of rolls is a drivable member. Their additional duty is to guide the printing plates, for which reason succeeding roll gaps are aligned with each other in a common line of sight and the lower roll 11 has a groove 12 near its one end for accommodating the bent edge of the printing plates. The grooves 12 of the lower rolls are also aligned with each other in a common line of sight. The pair of rolls at the output side of each work station has the additional duty of squeezing out the liquid off the printing plate. Therefore, the rolls are equipped with, for example, a rubber casing which also provides the friction grip necessary for conveying the printing plates. To this end the upper rolls 10 are pressed against the lower rolls. For this purpose the upper rolls may be supported in a sprung bearing so that lifting them up is counteracted by a spring force.

In order to be able to feed printing plates 13 into the device with the bent edge 14 (see FIG. 2) correctly oriented so that the bent edge 14 will project into the grooves 12 of the lower rolls 11 or run adjacent to the end of the cylindrical surface of the lower rolls, a guide slot 17, formed by the lateral edge 15 of the table top and a guide rail 16 attached parallel to it, is provided which is aligned with the grooves 12 in a common line of sight.

Inserting printing plate 13 with bent edge 14 into guide slot 17 automatically ensures that it is conveyed correctly oriented towards the pairs of rolls, so that the bent edge 14 projects into the groove 12 of the lower roll 11 or is positioned next to the end of the cylindrical surface of the lower roll so that the plane area of printing plate 13 is gripped without interference by the upper roll 10 and the lower roll 11 and the printing side of the printing plate 13 pointing upward can be predried by squeezing out the liquid over its entire area. (see FIG. 3).

As shown in FIG. 4, the last pair of rolls in the rubberizing station 4 is used to apply a rubberizing liquid onto the top side of printing plate 13. For this purpose a spray pipe 18 is assigned to the upper roll 10 at the input side of the roll gap. It extends parallel to the upper roll 10 and sprays rubberizing liquid from a succession of nozzle openings 19 on a distributor plate 20 which is sprung against the upper roll 10 and distributes rubberizing liquid as a film 21 on the upper roll which applies it to the roll gap onto the top side of print plate 13. At the output side of the roll gap an air blow tube 22 is provided above the roll gap extending parallel to the upper roll 10. Along its length are provided nozzle openings 23 which point toward the roll gap and from which air is blown in the output side of the roll gap in order to prevent rubberizing liquid to leak through the roll gap. At some distance from the air blow tube 22, tow additional air blow tubes 24 and 25 are provided, one above and one below the printing plate 13 blowing cold or, if required, warm air on both sides in a final drying treatment.

The dried printing plates 13 are conveyed to the output table 6 which is shortened on the left side, looking in the conveying direction, to the extent that the lateral edge 27 of the table top is no longer in the line of sight with the groove 12 in the lower roll, so that the bent edge 14 of the printing plate is conveyed adjacent to the edge 27.

I claim:

1. Device for washing and drying printing plates comprising an input table, a successive series of work stations for washing, rinsing rubberizing and drying, Page 2 each of said work stations having a pair of rolls having horizontal axes of rotation, each pair of rolls having an opening between the rolls, said openings being level with the input table, at least one roll per pair of rolls being driven in order to convey printing plates through said openings by gripping the printing plates with the rolls, an output table, said work stations being positioned along a common line of sight coinciding with the conveying direction of the pair of rolls and longitudinal guides, said guides all being situated either above or below the opening between rolls and adjacent to the opening between rolls, said longitudinal guides marking the boundaries of an unobstructed passageway through all of said stations.

2. A device according to claim 1, in which the longitudinal guides are situated below the opening between rolls.

3. A device according to claim 1, in which the longitudinal guides are formed by a circumferential groove in the cylindrical surface of either the upper or lower roll of each pair of rolls.

4. A device according to claim 1, in which the longitudinal guides are formed by one end of the cylindrical surface of the roll and by a guide rail, opposite to said one end.

5. A device according to claim 1, characterized in which the longitudinal guides extend into the input table.

6. A device according to claim 5, in which the input table is provided with a longitudinal slot as a guide means.

7. A device according to claim 1, wherein the rubberizing work station includes a roll for applying a rubberizing liquid onto the printing plates, said rubberizing work station being equipped with an air blow tube positioned parallel to it, said air blow tube having nozzles directed against the output side of the opening between the rolls.

8. A device according to claim 2, including a circumferential groove in the cylindrical surface of the upper or lower roll, said circumferential groove forming the longitudinal guides of each pair of rolls.

9. A device according to claim 2, wherein the longitudinal guides are formed by one end of the cylindrical surface of the roll and by a guide rail, positioned opposite to it.

10. A device according to claim 2, wherein the longitudinal guides extend into the input table.

11. A device according to claim 3, wherein the longitudinal guides extend into the input table.

12. A device according to claim 4, wherein the longitudinal guides extend into the input table.

13. A device according to claim 2, wherein the work station for the rubberizing treatment, a roll by means of which a rubberizing liquid is applied onto the printing plates is equipped with an air blow tube having a plurality of nozzles positioned parallel to the blow tube and directed against the output side of the opening between rolls.

14. A device according to claim 3, wherein the work station for the rubberizing treatment, a roll by means of which a rubberizing liquid is applied onto the printing plates is equipped with an air blow tube having a plurality of nozzles positioned parallel to the blow tube and directed against the output side of the opening between rolls.

15. A device according to claim 4, wherein the work station for the rubberizing treatment, a roll by means of which a rubberizing liquid is applied onto the printing plates is equipped with an air blow tube having a plurality of nozzles positioned parallel to the blow tube and directed against the output side of the opening between rolls.

16. A device according to claim 5, wherein the work station for the rubberizing treatment, a roll by means of which a rubberizing liquid is applied onto the printing plates is equipped with an air blow tube having a plurality of nozzles positioned parallel to the blow tube and directed against the output side of the opening between rolls.

17. A device according to claim 6, wherein the work station for the rubberizing treatment, a roll by means of which a rubberizing liquid is applied onto the printing plates is equipped with an air blow tube having a plurality of nozzles positioned parallel to the blow tube and directed against the output side of the opening between rolls.

* * * * *